US005495079A

United States Patent [19]

Joyce

[11] Patent Number: 5,495,079

[45] Date of Patent: Feb. 27, 1996

[54] PRESSURE SWITCH CALIBRATION

[75] Inventor: Ronald S. Joyce, Elk Grove Village, Ill.

[73] Assignee: Eaton Corporation, Cleveland, Ohio

[21] Appl. No.: 153,738

[22] Filed: Nov. 16, 1993

[51] Int. Cl.[6] ..... H01H 35/24

[52] U.S. Cl. ..... 200/81 R; 200/83 P; 200/83 S; 200/83 SA

[58] Field of Search ..... 200/81 R, 83 R, 200/83 S, 83 SA, 83 W, 83 WM, 83 P, 83 J

[56] References Cited

U.S. PATENT DOCUMENTS

| | | | |
|---|---|---|---|
| 4,262,178 | 4/1981 | Berlin, Jr. | 200/81 R |
| 4,617,432 | 10/1986 | Hanssen et al. | 200/81 R |
| 4,900,728 | 2/1991 | Joyce | 200/83 WM X |
| 5,109,144 | 4/1992 | Kaigler | 200/83 WM X |
| 5,192,840 | 3/1993 | Kaigler | 200/83 WM X |
| 5,393,945 | 2/1995 | Joyce et al. | 200/81 R |

*Primary Examiner*—J. R. Scott
*Attorney, Agent, or Firm*—Roger A. Johnston

[57] ABSTRACT

A pressure switch has a housing with a mounting bracket and a flexible diaphragm defining a wall of the pressure sensing cavity in the housing. Movement of the diaphragm operates an electric switch. The diaphragm is spring biased and an adjustment arm is frictionally mounted in a pair of guide surfaces on the mounting bracket. The arm contacts a cap on one end of the bias spring and is movable in the guide surfaces for adjusting the position of the spring cap for calibration. The mounting bracket is mounted to the housing by inserting a lug on the bracket in a recess in the housing and crimping a folded tab on the bracket to engage another recess in the housing. In another embodiment using a housing of all molded plastic, the adjustment arm frictionally engages a slot molded in the housing and is moved in the slot for calibration.

6 Claims, 2 Drawing Sheets

PRESSURE SWITCH CALIBRATION

BACKGROUND OF THE INVENTION

The present invention relates to devices for operating an electrical switch in response to changes in sensed pressure in a cavity, commonly known as pressure switches, and particularly relates to pressure switches of the type having a pressure responsive member, such as a piston or flexible diaphragm defining a wall portion of the sensing cavity and movable in response to changes in pressure in the cavity. Pressure switches of the type employing a flexible diaphragm for sensing pressure are commonly employed in household washing machines for sensing pressure in a tube connected to the bottom of the washing machine receptacle or tub such that the sensed pressure is directly related to the height or depth of the water in the tub. If the washing machine tub is filled above a predetermined level, the hydrostatic pressure of the water fill is applied to the pressure switch diaphragm, and actuates an electrical switch for disabling the water fill valve or mechanism.

In the typical diaphragm-type pressure switch, the diaphragm is resiliently biased and preloaded by a spring; and, the preload is adjusted for calibration by an adjustment screw provided in a movable adjustment lever provided on the housing structure with the screw bearing against a movable spring reaction member such as a cap over one end of the preload spring. The movable adjustment lever is typically provided to enable user-adjustment of the pressure settings for switch actuation. In washing machine applications for the pressure switch, the user adjustment of the pressure settings corresponds to different desired levels of water in the machine wash tub.

Where an adjustment screw is used to alter the position of a reaction member attached to the preload spring, it is necessary to secure the adjusted position of the screw such as with an adhesive or mechanical crimping or staking. This construction has resulted in a costly and troublesome operation in mass production of pressure switches for household washing machines, and has also resulted in problems in field service where the means for securing the screw adjustment have failed, causing the pressure switch to change calibration. Thus, it has long been desired to provide an improved, more reliable and lower cost way of providing for calibration of a pressure switch.

SUMMARY OF THE INVENTION

A pressure switch housing has a pressure responsive member in the form of an elastomeric diaphragm which forms a portion of a wall of a pressure-sensing cavity in the housing; and, the diaphragm is resiliently biased by spring-loading for controlling the movement thereof in response to changes of pressure in the cavity. The movement of the diaphragm actuates a snap-acting switch for providing making and breaking of a set of electrical contacts adapted for external connection to a circuit to be controlled. The spring providing the diaphragm load has a movable cap over one reaction end thereof, which is positioned during calibration by an adjustment arm which directly bears against the cap. The adjustment arm may be moved by a user-rotated cam to alter the position thereof of the spring cap for selecting a desired pressure at which the electrical switch will actuate. The adjustment arm has portions thereof frictionally engaged with a pair of spaced-parallel guide surfaces provided on the mounting bracket attached to the switch housing. A registration surface or hole is provided on the bracket, into which a tool is inserted which has an eccentric thereon engaging a slot in the adjustment lever. Rotation of the tool moves the adjustment arm in the guide surfaces to adjust the arm position of the preload cap with respect to the housing to adjust the loaded length of the spring.

In another embodiment, the switch housing has the guide surfaces formed integrally, such as by molding the housing of plastic therein, and the adjustment lever is slidably mounted in the guide surfaces and moved therein for calibrating the switch by frictional engagement with the guide surfaces.

DETAILED DESCRIPTION

Figure 2:
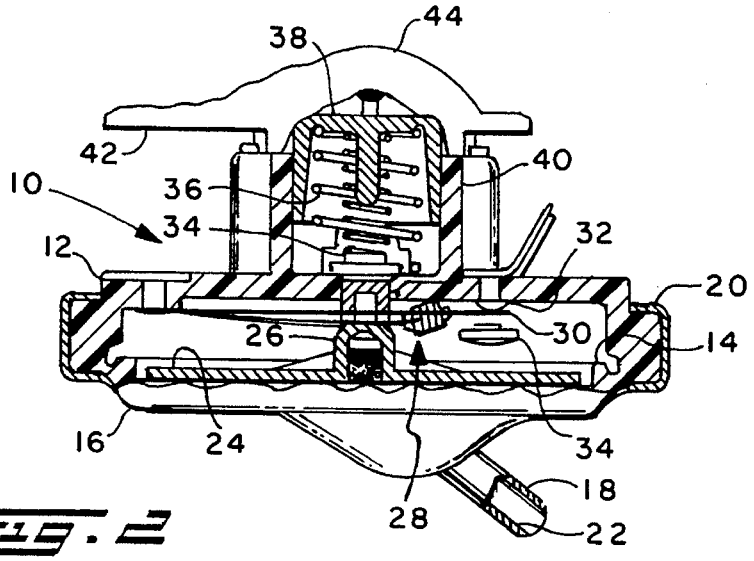
FIG. 2 is a side view, shown in section, of the pressure switch of FIG. 1.

Referring to FIGS. 1 through 4, a pressure switch employing the invention is indicated generally at 10, and has an upper housing shell 12 which has a resilient elastomeric diaphragm 14 sealed at its periphery about the housing by a cover 16 having a fluid port defining nipple 18 formed thereon with the periphery of the cover 16 crimped about the housing 12, as denoted by reference numeral 20 in FIG. 2. Cover 16 defines with the lower surface of diaphragm 14 a fluid pressure sensing cavity which communicates with the sensing port 22 formed in nipple 18.

Typically, the diaphragm 14 has a backing plate 24 which has a central portion 26 which bears against a snap-acting switch mechanism indicated generally at 28, which is operative for moving a blade member 30 for switching between a set of electrical contacts denoted by reference numerals 32 and 34 in FIG. 2.

Housing 12 has a lower spring reaction member or plunger 34 slidably received therein which registers against a central portion of diaphragm insert 26. The member 34 has the lower end of a preload spring 36 received and registered on a flange provided thereon; and, the upper end of spring 36 has received thereover a reaction member comprising spring cap 38 which is slidably received in the upper or tower portion 40 of housing 12.

Housing 12 has a mounting bracket 42 attached thereto by means described hereinafter. The bracket 42 has an upstanding or right angle portion 44 provided at one end thereof. A second vertically extending portion or riser is provided on the mounting bracket, and is disposed in generally spaced-parallel arrangement with the flange 44, as denoted by reference numeral 46 in FIGS. 1 and 2. An aperture 48 is formed in flange 44; and, a corresponding aperture 50 is aligned therewith and formed in riser 46. A shaft 52 is received through the apertures 48, 50, and has a cam 54 provided thereon which is operative, upon user rotation of the shaft 50, by a suitable knob (not shown) attached thereto to provide adjustment to the pressure settings of the switch, as will hereinafter be described.

Bracket 42 has a downwardly-projecting preferably hook-shaped lug 56 provided thereon, which is received through a slot 58 provided in the upper surface of tower portion 40 of the housing 12 with the lug 56 engaging the undersurface 60 of the housing tower 40.

Figure 1:
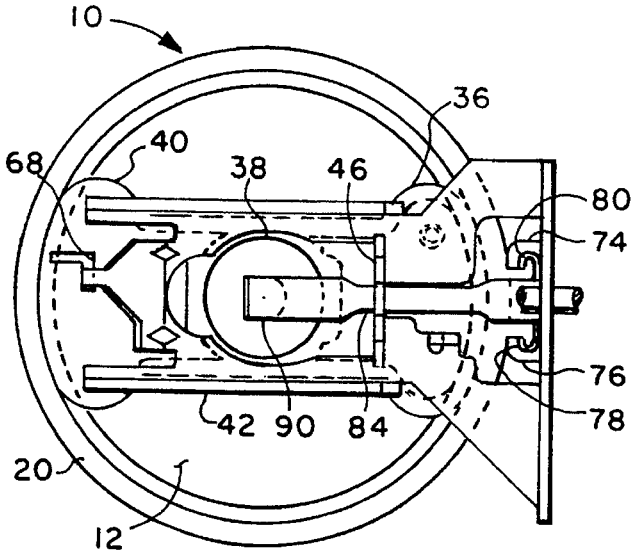
FIG. 1 is a top view of a pressure switch employing the calibration mechanism of the present invention.
Figure 3:
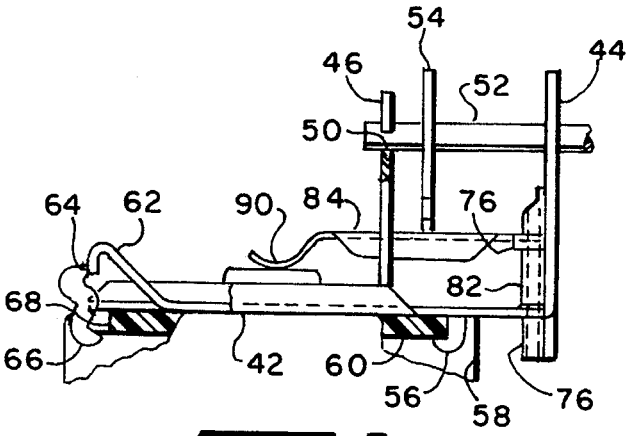
FIG. 3 is a front view of the top portion of the pressure switch of FIG. 1.
Figure 4:
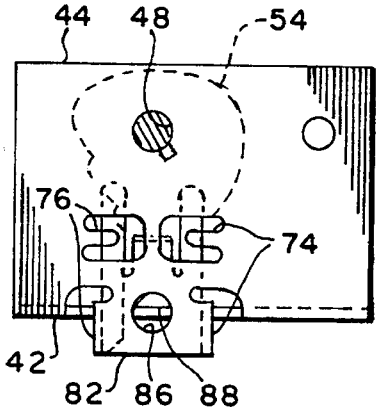
FIG. 4 is a left-hand end view of the embodiment of FIG. 3.
Figure 5:
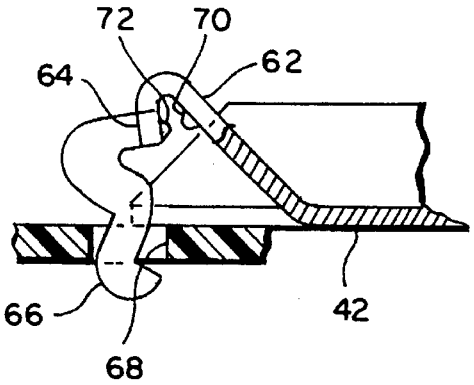
FIG. 5 is an enlarged view of a portion of FIG. 3.
Figure 6:
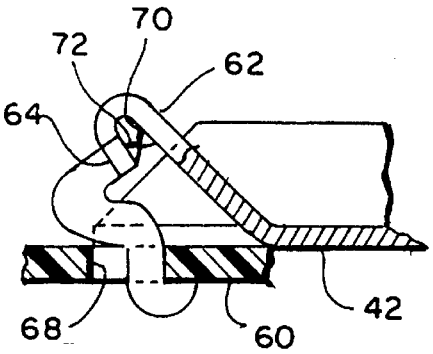
FIG. 6 is a view similar to FIG. 5, with the mounting bracket installation completed.
Figure 7:
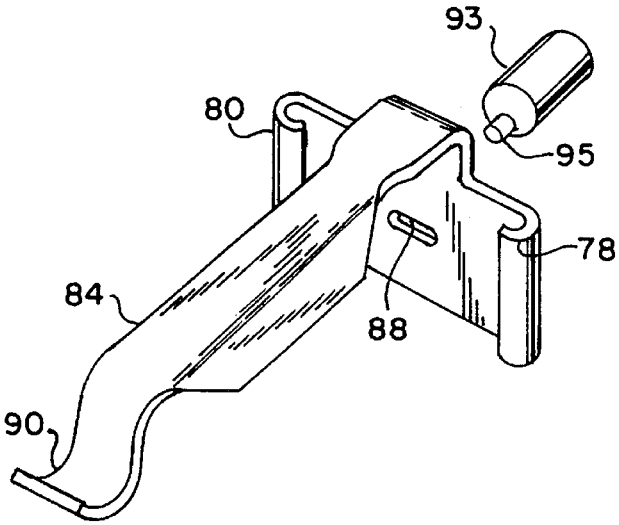
FIG. 7 is an axonometric view of the adjustment arm of the embodiment of FIG. 1; and, FIG. 8 is an exploded view, in perspective, of an alternate embodiment of the present invention.

Referring to FIGS. 3, 5, and 6, mounting bracket 42 has provided on the end thereof opposite flange 44 an upwardly angled portion 62, which has the end 64 thereof bent downwardly and formed in a laterally U-shaped configuration. Bracket end 64 has a hooked portion formed on the end thereof and folded at right angles thereto, as denoted by reference numeral 66. The hooked portion 66 is received in a recess or cut-out 68 formed in the upper surface of the housing portion 36, as shown in FIGS. 3 and 4.

Referring to FIG. 6, the U-shaped portion 64 of the end of the bracket 62 has been crimped or folded further upon itself wherein the hooked portion 66 has been rotated in a counter-clockwise direction from the position shown in FIG. 5, causing the hooked portion 66 to engage the undersurface 60 of the housing, as shown in FIG. 6. If desired, tabs 70, 72 may be formed on the inner sides of the U-shaped portion 64 for purpose of limiting the movement of the U-shaped portion 64 during the crimping operation, and to act as a strain relief to prevent the hook-shaped portion 66 from damaging during crimping the material of the housing of upper portion 36 which in the presently preferred practice is formed of molded plastic material. The arrangement of the tab 56 and 64, 66 on the bracket 62 thus provides a simple and economical way of attaching the bracket to the switch housing without the necessity of separate fasteners, such as screws.

Referring to FIGS. 1, and 3 through 6, the mounting bracket flange 44 has a pair of spaced generally parallel guides or ways 74, 76 formed thereon, preferably integrally therewith by stamping. An adjustment arm 84 is provided and extends in a generally horizontal direction outwardly from flange 44 and through a slot in riser 46 to have the end thereof disposed directly over and in contact with the upper surface of the spring cap 38. The adjustment arm 84 has a downwardly extending portion 82 with spaced generally parallel edges 78, 80 formed thereon which are received in frictional engagement between guides 74, 76.

The lower portion of flange 44 has an aperture 86 formed therein which coincides with a slot 88 formed in the vertical portion 82 of arm 84.

It will be understood that at assembly, the frictional engagement of the edges 78, 80 of the arm 84 in their engagement with the guides 74, 76 is sufficient to maintain the arm 54 in any desired position. In the present practice it has been found convenient, in order to calibrate the pressure switch, to utilize a round tool 93 sized to rotatably engage aperture 86 has a pin 95 or eccentric thereon which engages slot 88 upon insertion of the tool in aperture 86. Rotation of the tool in aperture 86 will cause the pin to engage slot 88 and move the arm 84 vertically in the guide 74, 76 to cause the end of the arm 90 to move the spring cap 38 to the desired position to provide the preload required to actuate the pressure switch at the desired pressure. If necessary, the guide surfaces or ways 74, 76 may be crimped or staked after calibration to secure the arm 84 in its calibrated position.

Once the arm 84 has been positioned for calibration, it will be understood that thereafter, rotation of the cam 54 effects cantilever deflection of the arm 84 with respect to the guides 74, 76 for changing the position of the spring cap 38 to vary the setting of the pressure switch.

Figure 8:
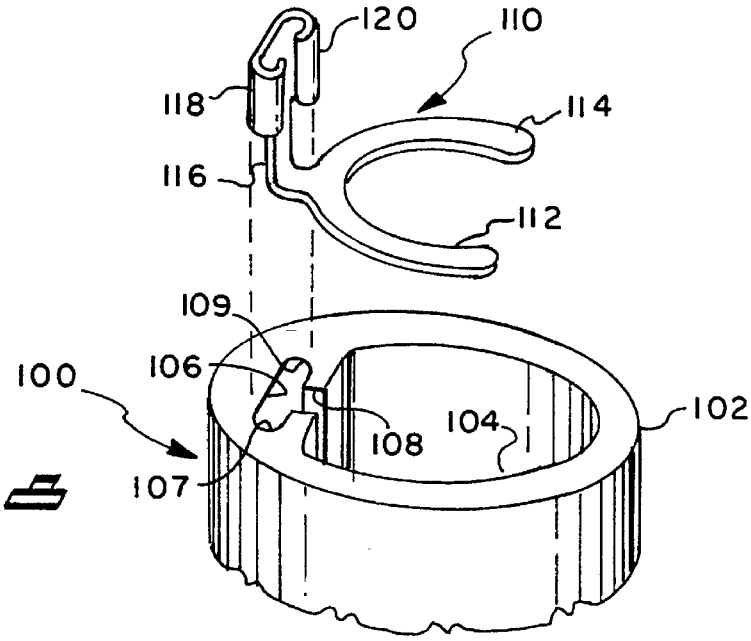

Referring to FIG. 8, another embodiment of the invention is illustrated as applied to a pressure switch indicated generally at 100, which is of the molded plastic type, as described in my U.S. Pat. No. 4,990,728, which employs a bifurcated or forked lever arm pivotally mounted in the housing for contacting and moving the preload spring cap within the switch housing, and which is in the prior art, is adjusted typically by an adjustment screw. In the embodiment of FIG. 8, of the present invention switch housing 102 has a central cavity 104 in which is received a preload spring and cap (not shown) for adjusting the calibration of the pressure switch.

A second recess or cavity 106 is formed in the switch housing in spaced-parallel relationship with the central cavity 104; and, the second cavity 106 is interconnected to the cavity 104 by a slot 108 formed therebetween. The recess 106 has the opposite sides thereof denoted by reference numerals 107,109 formed to provide guides or ways analogous to the guide surfaces 74, 76 of the embodiment of FIG. 1.

An adjustment arm indicated generally at 110 is provided, and has a forked or bifurcated end comprising generally spaced-parallel portions 112,114 extending from the central portion 116, which is formed at generally right angles to the portions 112,114. The main portion 116 has the opposite sides thereof adjacent the end formed to a generally C-shaped configuration in transverse section to form guide surfaces 118,120, which are sized to frictionally interfit the sides 107,109 of slot 106. The arm 110 may thus be inserted in housing 102 by inserting the main section 116 in slot 108 and engaging the sides 118,120 frictionally with slot 106 in positioning the arm 110 therein at a position to provide the desired positioning of members 112,114 against a spring cap for providing the desired preload. The arm 110 of the present invention may thus be adjusted without the need of the adjustment screw employed in the prior art as, for example, in my earlier U.S. Pat. No. 4,990,728.

The present invention thus provides a simple and economical adjustment technique for calibrating a pressure switch, which simplifies the calibration operations in high volume production and reduces manufacturing costs.

Although the present invention has been described hereinabove with respect to the illustrated embodiments, it will be understood that the invention is capable of modification and variation, and is limited only by the following claims.

I claim:

1. A method of calibrating a pressure switch of the type having a housing with a resiliently biased pressure responsive member defining a pressure sensing cavity in the housing with a preload member moveable for changing the bias and a switch actuated by a pressure responsive member and a switch actuated by the pressure responsive member, said method comprising:

(a) providing a mounting bracket and disposing a moveable cam thereon and forming a pair of guide surfaces on said bracket;

(b) providing an adjustment member and frictionally engaging said member on said guide surfaces for contacting said cam;

(c) attaching said bracket to said housing; and, (d) engaging a tool with said adjustment member and moving said member with said tool on said guide surfaces against said frictional engagement and positioning said preload member with said adjustment member and calibrating said pressure switch.

2. The method defined in claim 1, wherein said step of frictionally engaging includes providing a pair of spaced parallel ways on the mounting bracket and forming a pair of corresponding ways on said adjustment member and slidably engaging said ways with said adjustment member.

3. The method defined in claim 1, wherein said step of engaging a tool includes registering a tool on said bracket and said step of moving said bracket includes rotating said tool.

4. A method of calibrating a pressure switch of the type having a housing with a resiliently biased pressure responsive member defining a pressure sensing cavity therein with a preload member moveable for changing the resilient bias and a switch actuated by the pressure responsive member comprising:

(a) providing a mounting bracket with a moveable cam thereon and forming a pair of guide ways on said bracket;

(b) providing an adjustment member and frictionally engaging said member on said guide ways to contact said cam;

(c) forming a plurality of integral mounting tabs on said bracket;

(d) engaging said tabs on said housing and deforming one of said tabs for securing said bracket to said housing; and, (e) engaging a tool with said adjustment member and moving said member with said tool in said ways against said frictional engagement and positioning said preload member with said adjustment member for calibrating said pressure switch.

5. A method of calibrating a pressure switch of the type having a housing with a resiliently biased pressure responsive member defining a pressure sensing cavity therein and with a preload member moveable for changing the resilient bias and a switch actuated by the pressure responsive member comprising:

(a) forming a pair of spaced parallel guide ways in the housing;

(b) forming a bifurcated adjustment member and forming a pair of resilient guide portions thereon;

(c) frictionally engaging said guide portions of said adjustment member in said housing guide ways and positioning said preload member with said adjustment member and calibrating the pressure switch.

6. The method defined in claim 5, wherein said step of forming a pair of guide ways includes integrally forming said guide ways in said housing.

* * * * *